United States Patent [19]

Ghisoni

[11] Patent Number: 4,651,456

[45] Date of Patent: Mar. 24, 1987

[54] REVOLVER WITH REDUCED BACKLASH MOMENT

[76] Inventor: Emilio Ghisoni, Via Villa Serafina 4, Pavia, Italy

[21] Appl. No.: 663,439

[22] Filed: Oct. 22, 1984

[30] Foreign Application Priority Data

Oct. 21, 1983 [IT] Italy ..... 23387 A/83

[51] Int. Cl.[4] ..... F41C 1/00; F41C 19/14; F41C 21/22

[52] U.S. Cl. ..... 42/62; 42/59; 42/65; 42/77

[58] Field of Search ..... 42/59, 62, 65–67, 42/69 R–69 B, 77

[56] References Cited

U.S. PATENT DOCUMENTS

| | | | |
|---|---|---|---|
| 151,882 | 6/1874 | Jones | 42/59 |
| 3,027,673 | 4/1962 | Oliver | 42/59 |
| 3,221,433 | 12/1965 | Lewis | 42/65 |
| 3,269,045 | 8/1966 | McGaughey | 42/65 |
| 4,001,962 | 1/1977 | Baker | 42/65 |
| 4,213,263 | 7/1980 | Brouthers | 42/59 |
| 4,307,530 | 12/1981 | Melcher et al. | 42/67 |
| 4,316,339 | 2/1982 | Herriott | 42/59 |
| 4,416,078 | 11/1983 | Hillberg | 42/69.01 |

*Primary Examiner*—Stephen C. Bentley
*Assistant Examiner*—Michael J. Carone
*Attorney, Agent, or Firm*—Karl F. Ross; Herbert Dubno

[57] ABSTRACT

A revolver has a lowered firing line by alignment of the barrel with the lowermost chamber of the cylinder. The latter is swingably mounted on a frame at a location above the cylinder and cooperates with a firing mechanism in a compartment of the stock above the grip.

15 Claims, 5 Drawing Figures

REVOLVER WITH REDUCED BACKLASH MOMENT

FIELD OF THE INVENTION

My present invention relates to a revolver with a reduced backlash moment and, more particularly, to a revolver whose firing point is lowered by comparison with earlier revolvers and which therefore manifests a reduced backlash moment upon firing.

BACKGROUND OF THE INVENTION

Generally speaking, a revolver of conventional design comprises a stock formed with a grip, a frame mounted on the stock and provided with a barrel, and a cylinder swingable on the frame to allow the chambers of the cylinder to be successively aligned with the barrel.

To this end the barrel is located in line with the upper chamber of the cylinder and a pivot is formed for the cylinder close to a lower point thereof to allow the cylinder to swing out of its window in the frame for unloading of spent cartridges and reloading with bullets.

The firing point or axis, therefore, is generally located somewhat above the trigger and the stock at a considerable distance from the grip so that the recoil moment, i.e. the recoil force multiplied by the distance from the grip, is considerable.

This causes the barrel to lift, resulting in inaccuracies of firing and also represents a considerable force couple which is applied as a torque to the lower portion of the frame and especially to the transverse member thereof which must withstand this force couple.

As a consequence, the frame members which are subject to the force couple must be made relatively massive to avoid deformation of the frame caused by firing.

This, in turn, increases the weight of the firearm and the problem of rapidly aligning it with a target.

Conventional revolvers frequently utilize part of the lower transverse member as a fulcrum for the trigger and/or to support a mechanism which restricts the rotation of the cylinder, i.e. indexes the cylinder for firing and against rotation in an inactive condition of the weapon.

Such arrangements tend to reduce the rigidity of the lower transverse member still further so that when the force couples mentioned above are applied during firing, increased distortion is possible.

Here again, it is necessary to increase the thickness of the lower transverse member beyond an optimum thickness and this in turn means that the spacing between the cylinder above this lower transverse member and the grip will be greater. Furthermore, since the barrel diameter is more or less fixed by the number of cartridges which are to be accommodated therein, if one utilizes conventional numbers of cartridges per cylinder, one cannot correspondingly reduce the diameter of the cylinder so that the uppermost cylinder chamber and hence the cylinder and barrel must be even further spaced from the grip. This increases the lever arm over which the backlash or recoil force is applied to an even greater extend and thereby further accelerates the rearward and upward force components during firing.

OBJECTS OF THE INVENTION

It is, therefore, the principal object of the present invention to provide an improved revolver whereby the disadvantages enumerated above are eliminated or reduced.

Another object of this invention is to provide a revolver which does not require massive lower transverse members on the frame and even can utilize such lower transverse members for cylinder indexing and the like without requiring them to be of an increased thickness.

Another object of the invention is to provide a firearm of the revolver type which is more accurate and, especially, suffers less loss of accuracy from recoil or backlash forces than earlier firearms utilizing cartridges of the same type.

Still another object of this invention is to provide an improved revolver in which the firing and cylinder displacement mechanism is more reliable and efficient and which has a reduced tendency to suffer from frame distortion resulting from the firing action of the weapon.

Yet a further object of my invention is to reduce the dimensions of a revolver having a cartridge cylinder without impairing its ballistic quality, to improve the grip and handling of the revolver, and to reduce the effects of the backlash or more forces inducing sudden rearward motion upon firing.

It is also an object of this invention to provide a revolver whose stock and frame can have a construction allowing various barrel lengths to be accommodated removably and interchangeably.

SUMMARY OF THE INVENTION

These objects and others which will become more readily apparent hereinafter are attained, in accordance with the present invention, in a revolver which comprises a stock formed with a grip and provided with a firing mechanism actuated by a trigger adjacent the grip, a frame connected to this stock, a cylinder swingably mounted on this frame and a barrel mounted on the frame and positioned so as to be aligned with the lowest chamber of the cylinder, thereby reducing the backlash or coil moment on firing by lowering the firing point or axis to a location close to the grip and trigger.

The stock is provided within or directly above the grip with a compartment receiving the firing mechanism and the cylinder is rotatable, as is customary, about an axis parallel to that of the barrel and the firing chamber aligned therewith. An arm forming part of the frame is pivotally mounted thereon for swinging movement about an axis above the cylinder and parallel to the axis of rotation of the cylinder, at locations at opposite ends of the barrel so that a portion of this arm frames the window into and out of which the cylinder may be swung.

According to a feature of the invention, the barrel has a threaded intermediate section for attachment to the stock and an annular relief on an end opposite the cylinder for locking a removable portion of the frame to a permanent base portion thereof. Accordingly, by varying the axial length of this removable portion of the frame in accordance with the barrel length, barrels of various length can be accommodated. This removable portion of the frame may carry the front sight and thus provide additional support for the front end of the barrel. The firing mechanism of the invention also is unique and will be described in greater detail in the specific description hereof.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
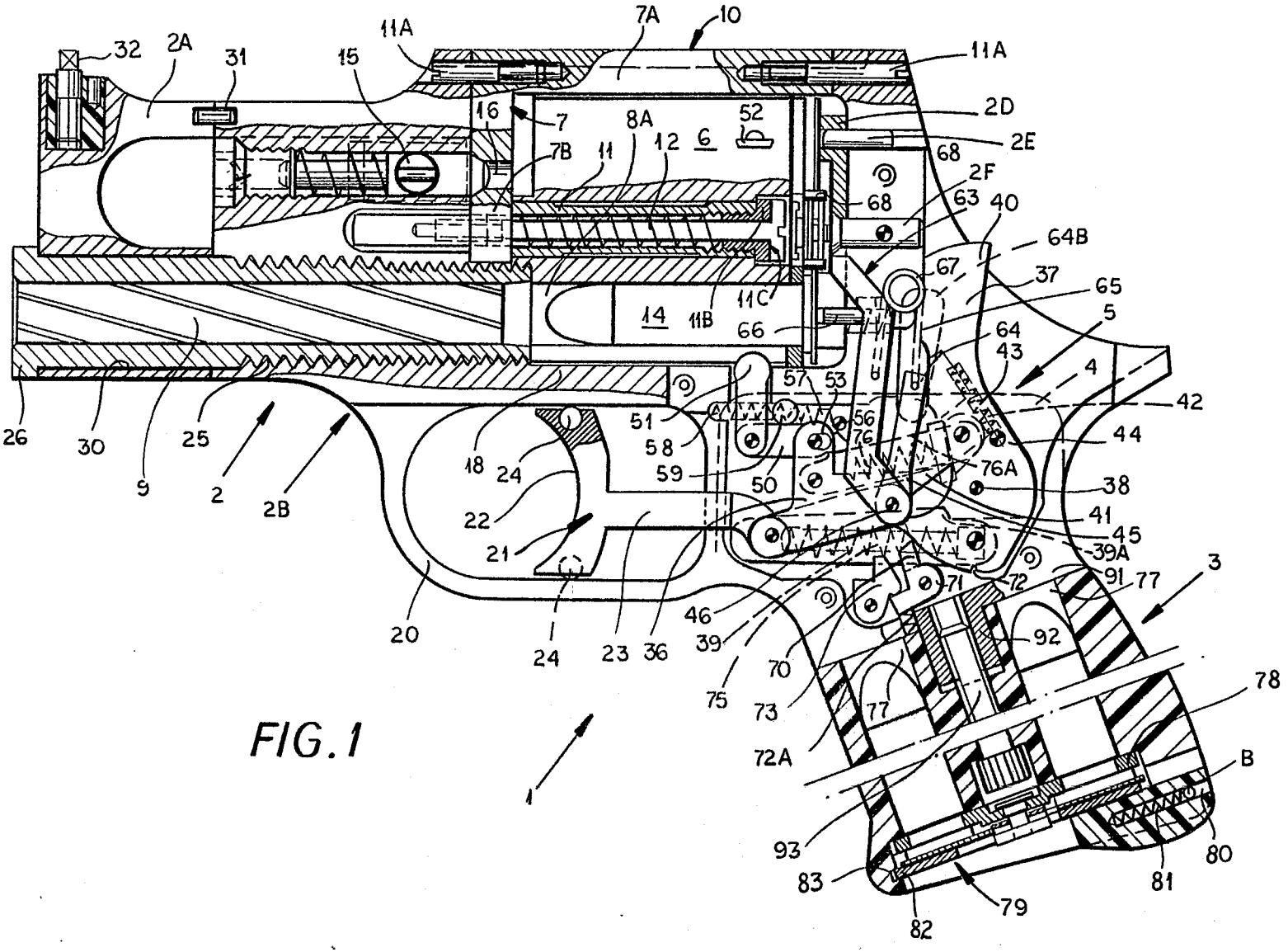
FIG. 1 is an axial cross sectional view with parts shown in elevation and partly turned away of a revolver according to the invention, certain parts such as springs and the like being illustrated in highly diagrammatic form.
Figure 2:
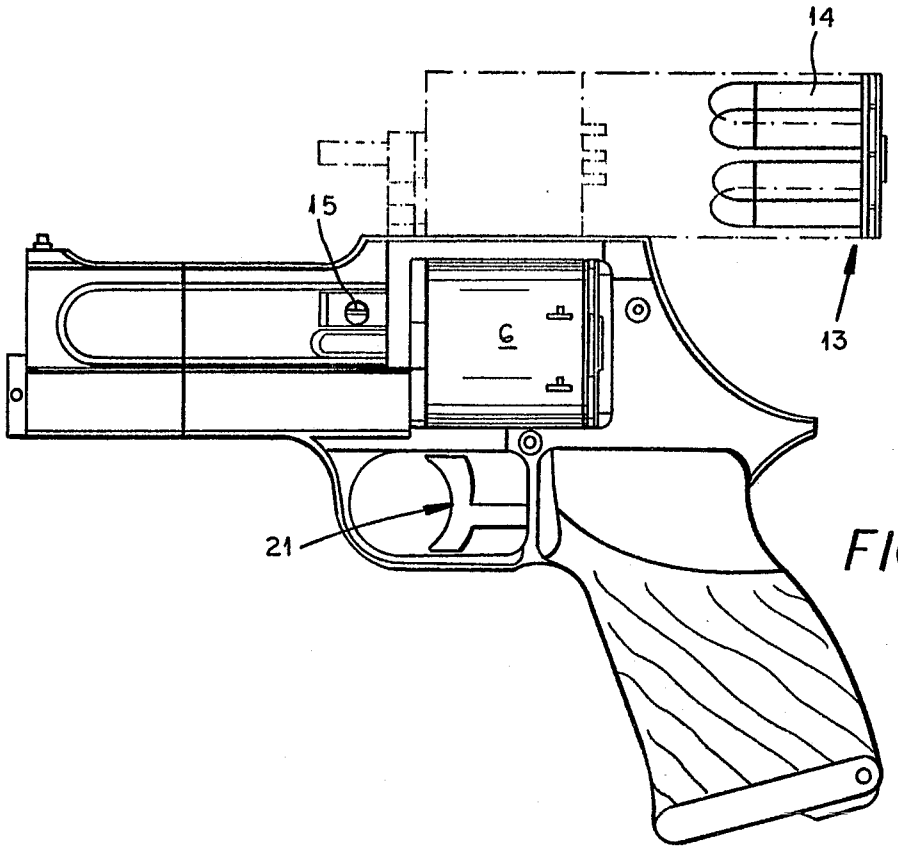
FIG. 2 is an elevational view of the revolver showing the cylinder swung outwardly into its alternative position in dot-dash lines.

From the drawing and especially FIG. 1, it can be seen that the revolver 1 according to the invention comprises a frame 2, preferably formed by a removable (replaceable) portion 2A and a base portion 2B, the latter having a stock wherein a grip area 3 is defined, topped by a compartment 4 receiving a firing mechanism 5. A cylinder 6 is axially rotatable in the frame and in kinetic cooperation with the firing mechanism.

The cylinder 6 is supported on an arm 7 pivoted to the frame and inside this cylinder 6 are as usual several recessed firing chambers 8 of which the lowermost or firing chamber 8A is aligned with a barrel 9.

Obviously the lower firing chamber is defined depending on the rotation of the cylinder and will correspond to that chamber 8 which is closest to the grip 3.

The alignment between the barrel and the lower firing chamber defines the axis of forces generated by the reaction effect during firing and determines a better distribution of the stresses to which the stock is subjected at this stage. The arm 7 is pivotally connected to the upper part of the stock at the opposite side of the cylinder 6 from chamber 8A.

Figure 3:
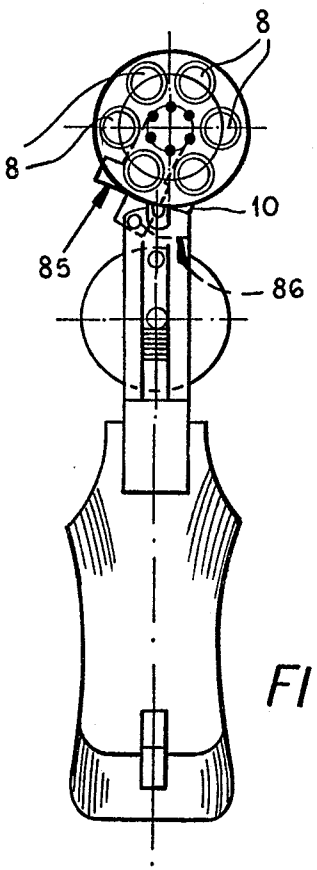
FIG. 3 is an end view of the revolver with its cylinder swung upwardly.
Figure 4:
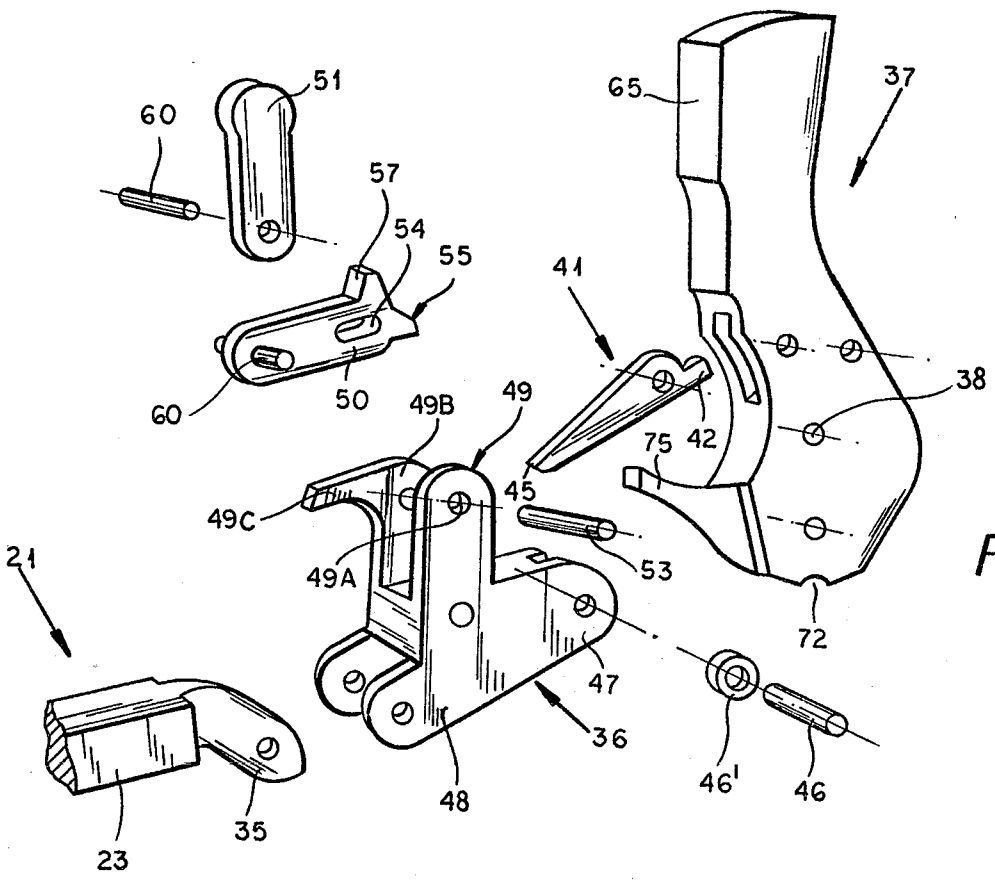
FIG. 4 is an exploded view of a portion of the firing mechanism showing the novel motion-distributing element thereof.
Figure 5:
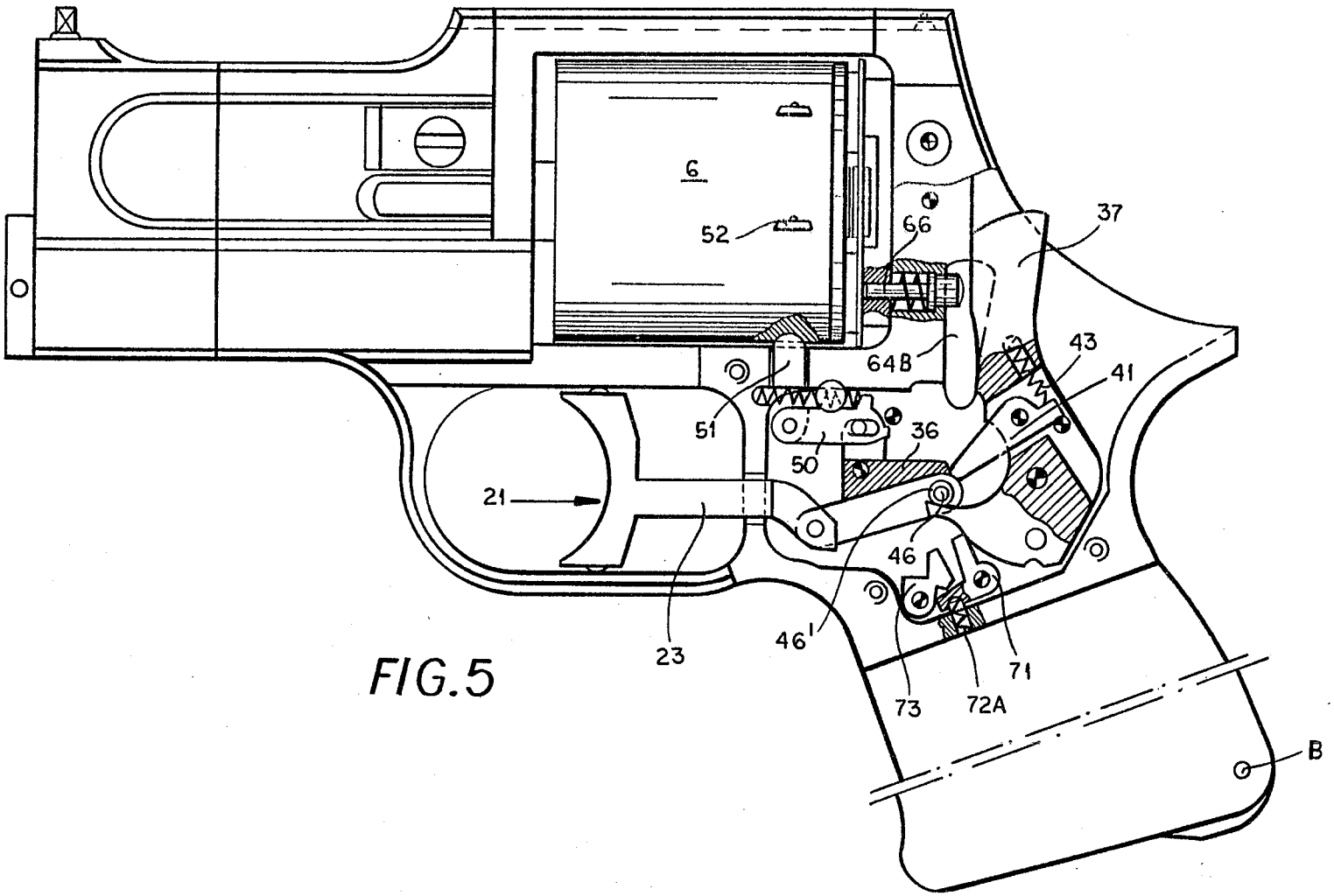
FIG. 5 is a side elevational view of the revolver partly broken away to show only a portion of the firing mechanism and the mechanism for retaining the cylinder against rotation for illustrative purposes.

More specifically, the arm 7 has an upper branch 7A constituting, when the cylinder is ready for firing, a portion of an upper transversal member 10 of the frame, as shown in FIG. 3.

Thus this partial weakening of the stock does not in any way influence the mechanical strength of the firearm inasmuch as due to the above-described configuration the stresses transmitted to the upper part of the stock are reduced practically to nil. The pivoting of the arm takes place via a pair of pins 11A aligned on the upper branch and rotatable in the stock while the cylinder 6 is supported on a portion 7B perpendicular to the arm portion 7A rotating freely on a sleeve 11 integrated with the portion 7B of the arm.

A ring nut 11B engages the sleeve 11 at the end opposite to the branch arm portion 7B and cooperates with a seat of the ledge 11E on the cylinder to arrest the latter on the sleeve when it swings around the pivot axis defined by the pins 11A.

An ejector 12 is slidably inserted coaxially to the sleeve 11 to discharge from the explosion chambers of the cylinder a loader 13 supplied with a plurality of projectiles 14.

The frame 2, in the area defined between the upper pivot point of the arm 7B supporting the cylinder and the axis of the cylinder carries a slidable plunger 15 elastically pressed against the arm portion 7B where it engages a corresponding recess 16 thereon, provided with an inclined lip to facilitate its engagement with the plunger 15 when the cylinder is in a firing position to avoid rotation around the pins 11A. The plunger 15 has a lateral screw 15' which facilitates its engagement to release the cylinder for loading.

In the area immediately subsequent to the lower explosion chamber of the cylinder, the stock has a lower transversal member 18 whose thickness can be conveniently reduced for the same reason mentioned in the case of the upper transversal member, due ultimately to the fact that they do not have to serve as a location for the pivoting means of the firing mechanism or for means of arresting the cylinder and do not have to take up substantial moments.

This advantageously allows for a lowering of the cylinder with respect to the traditional mounting positions of the same with the consequence that, besides a reduction of the vertical dimensions of the revolver, a further reduction of the sudden rearward motion of the firearm during firing is achieved.

The lower transversal member 18 extends over a guard 20, which is part of the stock for the trigger 21 preferably consisting of a pressure portion 22 sliding in the guard and a rod 23 for transmitting the effort applied on the trigger to the firing mechanism.

Advantageously, at the opposite sides of the pressure portion, balls 24 are provided to reduce the friction effect during sliding and also to guide the motion of the trigger in the guard.

The barrel 9 presents advantageously an intermediate externally threaded portion 25 which is attached by threading into the stock. Furthermore, on the end opposite to the cylinder an annular shoulder 26 is provided, on which driving means to facilitate the screwing of the threaded portion can be mounted with the purpose of axially locking the removable portion 2B 2A to the base portion of the frame 2.

Besides facilitating the replacement of the barrel either for maintenance or for the modification of the ballistic characteristics of the firearm, this arrangement also allows an equally rapid replacement of the portion 2A of the stock to be adapted to barrels of different length by simple substituting the portion 2A which is part of the equipment with an analogous portion of different dimensions. In fact the barrel is inserted through a bore 30 of the portion 2A which is preferably provided with means for centering and alignment with the base portion of the stock.

In a preferred embodiment, these means are constituted by a pin 31 on one of the two portions of the stock means to engage with a corresponding recess on the remaining portion.

The requirement to maintain the alignment is imposed by in fact that, in the example shown, on the removable portion 2A of the stock a target control 32 or sight is mounted to facilitate the aiming of the firearm. As previously described the trigger is connected to the firing mechanism via the rod 23. This rod has an essentially rectilinear development in the segment connected to the portion 22 of the trigger and then is bent downwards to form a member with a tooth-shaped end 35, whose function will become more clear from the following description.

The rod 23 is pivotally connected to a distributor 36 of the firing mechanism 5 via the member 35 with the tooth-shaped end. This mechanism 5 essentially comprises a cock 37 rotatable in a compartment 4 formed in the stock on a pin 38 and is elastically biased by a main spring 39 of the firing mechanism 5.

Preferably the cock has one extremity 40 protruding from the stock to permit the manual loading and the function of the revolver in single action.

A lever 41 with a peak is pivoted at one of its intermediate areas on the cock 37; the lever 41 presents at the opposite end an antirotational projection 42 suspended under the action of a spring 43 against an arresting pin 44 fixed in the cock and a contact area 45 engaging a first pin 46 coaxial with a bushing 46', mounted on the first lobe 47 of the distributing element 36, which has a trilobate configuration. A second lobe 48 receives the member with the tooth shaped end 35. A third lobe 49 not aligned with the first two fulcrums the distributing element 36 to the stock. Each of the lobes is preferably forked to better accommodate the engagement of the reciprocal parts and particularly the lobe 49 has a first branch 49A and a second branch 49B, the latter having an extension forming a portion ending with a peak 49C.

The peak-ended portion 49C interacts with the restraining means of the cylinder which preferably comprises a first lever 50 articulated at one extremity to an engaging element 51 vertically movable through a frame opening of the lower crossbar 18 to interact, guided by the distributor 36, with the restraining slots 52 recessed around the cylinder.

At the opposite end the first lever 50 rotatably engages the stock in a third pin 53, the same one used for fulcruming the distributing element via a slot 54 extending in the longitudinal direction of the first lever 50 The opposite end of the lever 50 also forms a cam surface 55 which cooperates in the actuation of the firing mechanism with a fixed pin 56 of the stock. The segment with the cam 55 is topped by a reaction tooth 57 being acted up by a compression spring 58 whose deflection is attentuated by a small cylinder having a guiding bore 59, the spring tending to bias the first lever 50 to maintain the contact of the pin 53 with the extremity of the slot 54 closest the engaging element 51 and also to establish in the rest position of the arresting means of the cylinder an interference fit between the engaging element 51 and the slots 52.

The interaction between the cam 55 and the fixed pin 56 creates for each rotation of the first lever 50 a relative translatory movement of the pin 53 in the slot 54. Such rotations are imparted during the actuation of the trigger from the peak-ended element 49C of the distributor 36 which comes into contact with an engaging element integrated in the first lever 50.

Such an engaging element can advantageously comprise an articulation pin 60 fulcruming the first lever 50 to the engaging element 51 and whose one extremity extends to actuate the contact with the peak-ended segment 49C.

The contact between the pin 60 and peak-ended segment 49C is subject to release under the effect of the relative translation between the third pin 53 and the slot 54, determined by the configuration of the cam-bearing segment 55.

On the distributing 36 element corresponding to the pin 46 a lever or pawl 63 for the advancement of the cylinder is further articulated, as well as an element with hammer 64 controlled by the trigger via the distributing 36 element for interpositioning between an area of the ledge 65 of the contact cock 37 and a striker of firing pin 66 axially aligned with the lower explosion chamber.

The striker is slidable in the stock, in a customary way and the element with hammer 64 interposes itself between the striker and the cock 37 during a loading run of the latter; a spring 67 is interposed between the lever 63 and the element with hammer 64 tending to keep them at a distance from each other.

The lever 63 interacts with stepping pins 68 arranged in a crown in a central area of the cylinder in such a manner that each elevation of the lever 63 produces an action tangential thereto, generating a partial rotation. A disk 2D of the frame, traversed by the firing pin 66, is held in position by pins 2E and 2F.

The manual cocking in the case of a single action of the cock is performed with the aid of a pawl 70 being a part of a bell crank lever 71 rotatably supported on the stock and cooperating with a notch 72 of the cock.

The lever 71 is biased by a spring 72A to urge the pawl 70 into engagmeent with the notch and is subjected to the action of a detent 73 pivoted on the stock in such a position as to be engaged by the member with the tooth-shaped end 35 of the rod 23 during the actuation run of the trigger.

A hook 75 provided on the cock 37 cooperates with the bushing 46' causing the locking of the trigger when the manual cocking of the cock 37 is in progress.

The rotation of the distributor 36 around the pin 53 can be subsequently counteracted by the presence of a spring 76 of the distributor, reacting on the stock. The springs of the cock 37 and of the distributor 36 are advantageously located in apertures, respectively 39A and 76A, recessed in the thickness of the stock wall corresponding to the compartment 4 and laterally bordering the elements of the firing mechanism submitted to their stress.

The firing mechanism as shown eliminates cumbersome undesired elements inside the grip, which can then accommodate a supply loader as shown in position in FIG. 1.

To this end, seats 77 are recessed in the grip for lodging a spare loader 78, the release of which is controlled by a swinging lid 79 hinged at B in the lower portion of the grip passing through a slot 80, a spring 81 counteracting between pin B and the lid 79 formed at the opposite side with a tongue 82 suited to engage a recess 83 of the grip, in order to form together an engagement device.

The compartment 4 of the stock is open corresponding to its upper rear area through which the extremity 40 of the cock extends while it is closed downwards by a wall 91 provided with a boss 92 with a threaded bore in which a screw 93 is threaded for locking the grip to the stock; the boss 92 provides means for positioning and resistance of the grip with respect to the stock.

The mode of operation of the revolver according to the invention results clearly from the description and illustration; particularly in the case of dual action, by pulling the trigger a rotation of the distributor 36 around the pin 53 is caused, consequently establishing contact between the peak-ended lever 41 and the bushing 46'.

Following the pulling of the trigger, the pin 46 reacts upon the peak-ended lever 41, which not being able to rotate as a result of the antirotational projection 42 resting against the pin 44 generates a rotation of the cock around the pin 38 for the cocking thereof.

Due to the rotation of the cock combined with the rotational movement of the distributor a gradual disengagement of the contact area 45 of the peak-ended lever 41 from the bushing 46' results, to the end that the latter surpasses the apex portion of the lever 41 permitting the lowering of the cock under the effect of the spring reacting thereupon.

In the same context, the hammer 65 is raised by the distributor in order to interpose itself between the area of the ledge 65 of the cock 37 and the striker thus permitting the conversion of the striking action of the cock 37 into a translatory action of the pin 66 which will induce the firing of the projectile 14 in the known manner; the hammer element 64 is guided in a seat for sliding 64B recessed in the wall of the stock.

At the same time, the rotation of the distributor 36 causes the lifting of the lever 63 for the advancement of the cylinder by engagement with the pins 68 and in the same context the unblocking of the arresting means 51 of the cylinder, whose detailed function was previously set forth.

In the case of the single action and in the case of the manual loading of the cock 37, the cocking thereof translates into a rearward backing of the trigger in the guard caused by a pulling effect of the hook 75 of the same cock on the bushing 46'.

The cocking of the hammer cock 37 is obtained when the pawl 70 engages with the recess 72 maintaining the cocked position.

A further backing of the trigger leads to an interference between the member with a tooth-shaped end 35 and the element 73 which causes the rotation of the lever 71 releasing the pawl from the notch permitting the descent of the cock on the striker.

The loading of the cylinder with a new magazine, possibly removed from the grip, takes place simply by moving the punger 15 away from the side opposite to the cylinder so that the same disengages the seal 16; when the cylinder 6 is rotated upwardly it assumes a balanced position very practical either for the expulsion of the old magazine or for the insertion of the new one.

In the reclosed position the arm 7B forms a rabbet on the stock with a surface 85 of the ledge of the branch 7A set against a surface 86 of the upper crossing facing the cylinder, having as a consequence the structural simplification of the firearm and facilitating the manufacturing of the stock in the area of the frame opening for the lodging the cylinder. The advantages of the revolver with a lowered cylinder as described becomes evident particularly where the possibility to contain its dimensions is concerned.

In fact, the dimensions are reduced with respect to the traditional revolver in legnth for an equal barrel 9, as well as in height for an equal working grip height.

Due to the lowered barrel 9 and to the subsequent lowering of the cylinder 6, the sudden rearward motion of the firearm during firing is drastically reduced, avoiding the moment generated by the backlash forces which carries the revolver out of aim at each shot. This results in a remarkable improvement of the control of the firearm and of its grip due to the retracted position of the firing mechanism, which, by not having elements fulcrumed in the lower crossbar 18 or in any way lodged therein, allows the latter to be used solely as a stiffening element for the revolver.

The absence of reaction springs of the cock inside the grip allows among other things the utilization thereof for the lodging of a spare cylinder magazine.

The invention as conceived lends itself to numerous modifications or variants, all of them being included in the object of this invention; besides all the parts are replaceable with technically equivalent elements.

In practice, the materials used and also the dimensions and the shapes can be of any kind in accordance with the requirements and the state of the art.

I claim:

1. A revolver comprising:

a stock formed with a grip at a lower portion thereof and a compartment above said grip;

a frame connected to said stock and provided with a window;

a cylinder swingably mounted on said frame and receivable in said window, said cylinder having a plurality of angularly equispaced chambers adapted to receive cartridges to be fired;

a firing mechanism in said compartment cooperating with said cylinder for firing a lowermost cartridge of said cylinder from a lowermost chamber thereof and for rotating said cylinder so that each chamber in turn forms said lowermost chamber; and a barrel mounted on said stock and aligned with said lowermost chamber whereby a firing reaction force is applied to said frame along a common axis of said barrel and said lowermost chamber close to said grip, said frame comprising a pivotal arm having a first portion extending across said window above said cylinder and pivotally connected to said frame at opposite ends of said cylinder, and another portion extending perpendicular to said first portion and rotatably carrying said cylinder, said mechanism including a cock swingably mounted in said compartment, a spring biasing said cock so that a striking portion thereof tends to be swung in the direction of said lowermost chamber, a peak-ended lever pivotally connected to said cock at an intermedia location thereof and having a peak end and an antirotation end, a trilobate force-distributing member pivotally mounted in said compartment, a trigger guard formed on said stock and defining a second frame directly forward of said compartment, a trigger mounted on said trigger guard in said frame forward of said compartment and having a tooth extending rearwardly into said compartment, said force-distributing member having a first lobe pivotally connected to said tooth by a pivot peg, a second lobe receiving a pin, said pin being engageable by said peak end, and a third lobe pivotally connected to said stock by a pivot peg and formed with a projection, and detent means engageable with said cylinder for indexing same against rotation and releaseable by said projection, said pin connecting said second lobe to a pawl for stepping said cylinder.

2. The revolver defined in claim 1 wherein said cock has an extremity extending from said stock.

3. The revolver defined in claim 1 wherein said spring and a distributor spring laterally flank said cock and said distributor member respectively.

4. The revolver defined in claim 1 wherein said pin of said second lobe of said distributor member is provided with a bushing, said bushing being engageable by a hook-shaped projection on said cock for drawing said trigger rearwardly when said cock is manually cocked.

5. The revolver defined in claim 1 wherein said barrel has a threaded portion and said frame has a base part and an end part movably connected to said base part, said barrel being further formed at an end thereof opposite said cylinder with an annular shoulder engageable with said end part for retaining an end part dimensioned to suit a particular barrel on said base part of said cylinder whereby barrels of different lengths can be interchangeably affixed to said frame along with respective end parts of said frame.

6. The revolver defined in claim 5, further comprising a positioning pin for aligning said parts with one another.

7. The revolver defined in claim 1 wherein said mechanism includes a hammer pivotally connected to said second lobe, a firing pin mounted in alignment with the lowermost chamber on said stock, said hammer being interposable between said striking portion and said firing pin.

8. The revolver defined in claim 7, further comprising a spring between said pawl and said hammer to bias them apart.

9. The revolver defined in claim 7 wherein said detent means includes an indexing element displaceable radially of said cylinder and engageable in recesses spaced circumferentially around said cylinder and an indexing lever pivotally connected to said element and to said third lobe, said indexing lever having a slot traversed by a pivot pin through said third lobe, said lever having a camming portion cooperating with a pin affixed on said stock and means for rotating said indexing lever formed by said projection.

10. The revolver defined in claim 1 wherein said compartment is closed downwardly by a wall having a projection external to said compartment and forming positioning means for said grip.

11. The revolver defined in claim 10 wherein said grip is formed with a plurality of recesses extending in a longitudinal direction of said grip for receiving cartridges of a spare magazine insertable in said cylinder.

12. The revolver defined in claim 10 wherein said cylinder is journaled on a sleeve provided on said other portion of said arm, an ejector rod extending through said sleeve and being engageable with a magazine of spent cartridges received in said cylinder for ejecting the same.

13. The revolver defined in claim 12 wherein said frame is provided with a detent pin engageable in said other portion of said arm at a location spaced from the pivot axis of said arm to releasably retain said cylinder in said window for firing.

14. The revolver defined in claim 13 wherein said trigger is shiftable in a trigger guard, said trigger being provided with balls on opposite sides thereof guiding said trigger linearly in said guard.

15. The revolver defined in claim 11 wherein said grip is formed with a pivotal lid at a free end thereof affording access to said spare magazine.

* * * * *